US005953946A

United States Patent [19]

Mücke et al.

[11] Patent Number: 5,953,946

[45] Date of Patent: Sep. 21, 1999

[54] APPARATUS FOR BEND-STRAIGHTENING METAL STRIP

[75] Inventors: Gert Mücke, Hilden; Eberhard Neuschütz, Ratingen; Helmut Thies, Kaarst, all of Germany

[73] Assignee: Betriebsforschungsinstitut VDEH-Institut fur Angewandte Forschung GmbH, Dusseldorf, Germany

[21] Appl. No.: 09/033,117

[22] Filed: Mar. 2, 1998

[30] Foreign Application Priority Data

Mar. 3, 1997 [DE] Germany ..... 197 08 488

[51] Int. Cl.[6] ..... B21D 1/06

[52] U.S. Cl. ..... 72/164; 72/160

[58] Field of Search ..... 72/164–165, 160–163

[56] References Cited

U.S. PATENT DOCUMENTS

| | | | |
|---|---|---|---|
| 3,389,591 | 6/1968 | Moline | 72/160 |
| 3,394,574 | 7/1968 | Franek | 72/164 |
| 3,605,470 | 9/1971 | Polakowski | 72/164 |
| 3,839,888 | 10/1974 | Greenberger | 72/161 |
| 3,841,132 | 10/1974 | Kuhn | 72/163 |

FOREIGN PATENT DOCUMENTS

| | | | |
|---|---|---|---|
| 1134278 | 4/1957 | France | 72/164 |
| 454981 | 12/1974 | U.S.S.R. | 72/164 |
| 1002936 | 9/1965 | United Kingdom | 72/160 |

OTHER PUBLICATIONS

Oct. 1986 Andreas Noé et al., "Theoretische und praktische Untersuchungen zum Streckbiegerichten" *Stahl und Eisen,* pp. 1131–1137.

*Primary Examiner*—Daniel C. Crane
*Attorney, Agent, or Firm*—Merchant & Gould P.C.

[57] ABSTRACT

In an apparatus for straightening metal strip comprising guide rolls arranged parallel to one another a straightening roll is arranged in the gusset space between two guide rolls which has the strip wrapped round it in a form-fitting manner between two lines of contact along which the guide rolls are in indirect contact with the straightening roll. This makes it possible to straighten even high-strength strip without the need to apply tensile loads which exceed the magnitude needed to transport the strip through the apparatus.

6 Claims, 5 Drawing Sheets

APPARATUS FOR BEND-STRAIGHTENING METAL STRIP

FIELD OF THE INVENTION

The invention relates to apparatus for straightening metal strip.

BACKGROUND AND PRIOR ART

Hot deformed, hot rolled and cold rolled metal strip often exhibits departures from flatness which need to be eliminated for further working and finally also for the use of the finished strip.

Such departures from flatness can take the form of curvature of the strip in the longitudinal direction, transverse curvature and transverse, central and edge waves or the formation of a camber as a result of differences in the width of the strip. Such strip cambers lead, over long transport distances, to lateral wandering of the strip. To prevent this, guide rolls which can rotate about an axis normal to the plane of the strip are required, and these are associated with substantial investment and are subject to high wear.

The defects referred to can lead to problems and to damage to the strip in its subsequent treatment. For example, in a looping tower or annealing furnace in which there are large free (i.e. unsupported) lengths of strip it can happen that the strip scrapes along guides or fixed plant, or that when a strip is guided along a meandering path sections which are moving in opposite directions ride over one another. This leads to damage to the surface of the strip, which either has to be eliminated by expensive repair operations or makes it impossible to process the strip to a saleable product. This danger is particularly great in the case of stainless steel strip, for which the surface quality requirements are particularly high. Moreover, departures from flatness in highly hardened stainless steel strip are particularly difficult to eliminate.

In order to eliminate departures from flatness it is, for example, known from "Stahl und Eisen", 1986, pp. 1131 to 1127, to pass the strip round several bending rolls under tension so as to subject it to deformation by bending in alternate directions while under tensile stress. The tensile stress is superimposed on the bending of the strip and the resulting straightening is due to the co-operation of changes in shape by bending and tension and is accordingly dependent on the one hand on the bending radius or angle of wrap on the straightening rolls and on the other hand on the tensile load exerted on the strip, which ensures a certain degree of stretching. In straightening by bending and stretching bending radius and tensile load are inversely related insofar as at constant tensile load the bending radius decreases as the strength of the strip material increases. To ensure an adequate bending radius it is therefore necessary to increase the tensile load as the strength of the material increases. To achieve this, the tension rolls on either side of the bending rolls which move the strip through the straightening apparatus require high driving power. This results not only in high capital costs but also in high operating costs, in particular energy costs.

OBJECT OF THE INVENTION

It is therefore the object of the invention to provide an apparatus which is particularly suitable for straightening strip of high-strength metallic materials and achieves this without the high capital and operating costs which are characteristic of superposed straightening by stretch-bend straightening.

SUMMARY OF THE INVENTION

The solution of this problem is based on the idea of passing the strip through at least one straightening roll assembly comprising two guide rolls and a straightening roll, so as to fit closely round the straightening roll, while establishing the lines of contact of the strip on the straightening roll so that the guide rolls press the strip directly on to the straightening roll. In each case the guide rolls form a straightening gap with the straightening roll and take up the position the shortest possible distance from the straightening roll, determined by the thickness of the strip, so that at the two lines of contact the strip is, as it were, clamped in a gap between the straightening roll on the one side and a respective guide roll on the other side. The radius of the straightening roll on the one hand and, on the other hand, the distance between the lines of contact or, expressed in another way, the depth of immersion of the straightening roll in the gusset space between the two guide rolls, then determine the bending radius. The bending radius acting on the strip, i.e. the effective radius, thus corresponds to the radius of the straightening roll.

In this way, by means of the depth of immersion of the straightening roll, the bending radius required to eliminate the departures from flatness can be adjusted independently of the strength or bending stiffness of the respective strip material and independently of the strip tension. The straightening therefore takes place by bending deformation, so that the strip tension does not need to perform any straightening work, but only serves to move the strip forward. Consequently the tensile load required remains far less than that required for stretching and bending of the strip as in the stretch-bend straightening.

If the tensile load required to move the strip through the straightener is left out of consideration, the plastic deformation needed to eliminate the departures from flatness is achieved solely by the depth of immersion of the straightening roll between the two guide rolls. The greater the depth of immersion, the farther apart on the surface of the straightening roll are the two contact or clamping lines, determined by the position of the three rolls relative to one another, and the greater is the effective or bending radius.

With reference to the cross-section of the rolls, the radii of the guide rolls intersecting at the centre of the straightening roll preferably pass through the guide roll/straightening roll/guide roll lines of contact.

In order also to even out so-called strip camber, i.e. sickle-shaped curvatures in the plane of the strip, the straightening roll can be arranged to be pivotable in the vertical plane. Inclination of the straightening roll relative to the plane of the strip results in different depths of immersion in the region of the two edges of the strip, and accordingly respective different respective bending radii, with the result that the greater bending radius leads to stretching of the edge of the strip where it is shorter and thus to straightening of the strip.

Since there is a direct connection between a transverse bowing of the strip and a longitudinal bowing, the depth of immersion of the straightening roll can be controlled by means of measuring data from several sensors distributed across the width of the strip to measure the distance of the surface of the strip from a zero line, by means of an algorithm. Preferably a sensor mounted above the middle of the strip serves as a reference sensor and sensors mounted on either side of the reference sensor serve to measure the distance of the strip surface from the zero line across the width of the strip.

BRIEF DESCRIPTION OF THE DRAWINGS

The invention is described below in more detail, by way of example, with reference to two embodiments illustrated in the drawings, in which.

DETAILED DESCRIPTION OF PREFERRED EMBODIMENTS OF THE INVENTION

Figure 1:
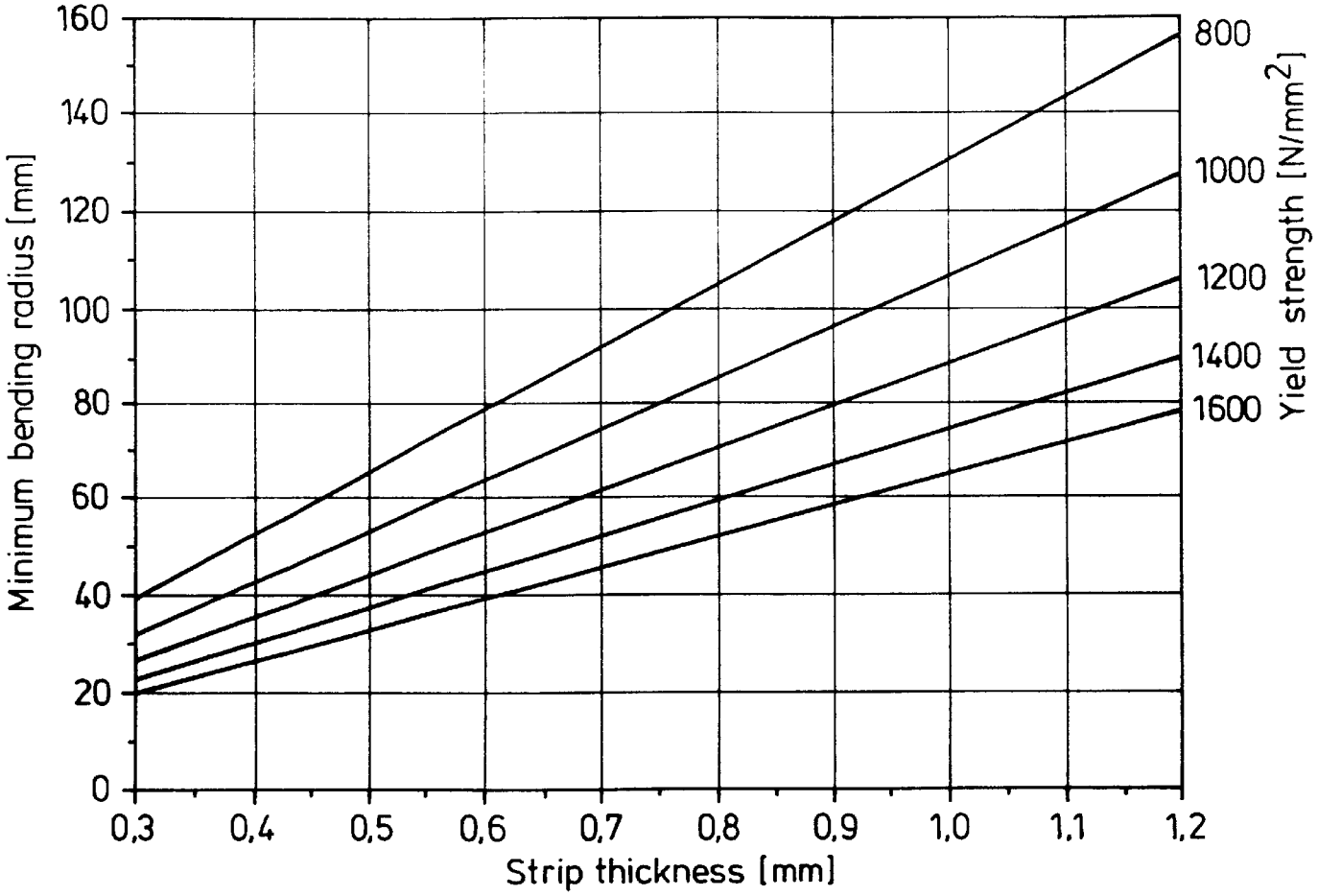
FIG. 1 shows graphically the relationship between the strip thickness, the yield strength of the material of the strip and the minimum bending radius.

Due to the relationship between the bending radius, the strip thickness and the yield stress of the material of the strip, as shown graphically in the diagram in FIG. 1, the limiting bending radius (minimum radius) for the strip, below which elimination or departures from flatness by plastic deformation of the strip can occur, is from 20 to 80 mm in the case of strip material having a yield stress of 1600 N/mm2 in the thickness range of 0.1 to 1.2 mm. In the case of steel strip 0.5 mm thick and 1300 mm wide, with conventional straightening the tensile loads would have to be so great that the resulting bending radius on the strip is less than about 30 mm.

Figure 2:
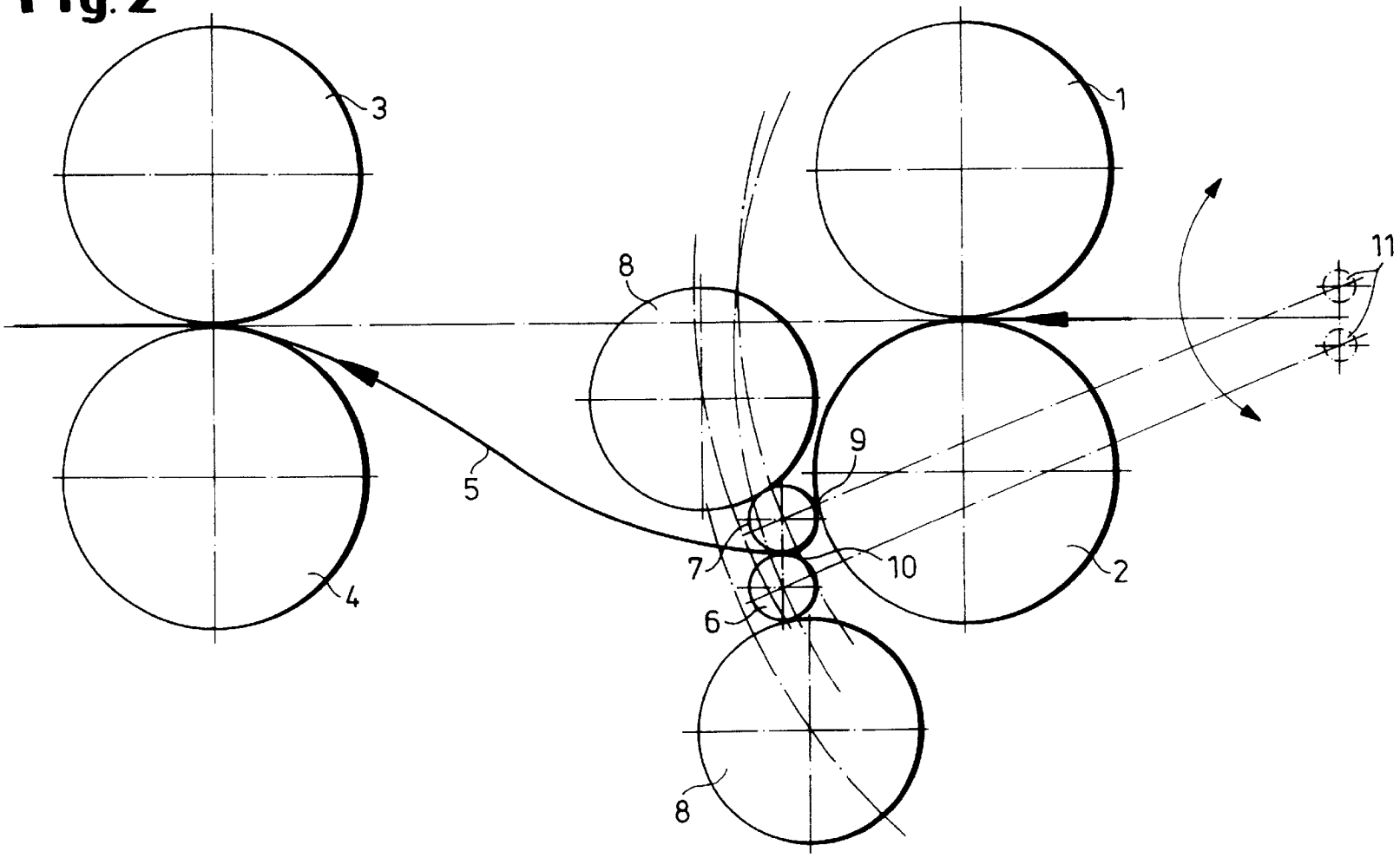
FIG. 2 is a section through a bend-straightening apparatus having one straightening roll and two guide rolls with different diameters.

The bend-straightening apparatus shown in FIG. 2 comprises two guide rolls 1, 2 on the feed side and two guide rolls 3, 4 on the exit side for the strip 5 which is passing through. Adjacent to the lower guide roll 2 there is mounted a further guide roll 6, which on account of its small diameter is supported by a backing roll 8. In the gusset space between the two guide rolls 2, 6 is mounted a straightening roll 7, which is similarly supported by a backing roll 8. The strip 5 fed in between the two guide rolls 1, 2 wraps round the straightening roll 7 with a bending radius or angle of wrap which is determined by the depth of immersion of the straightening roll between the two guide rolls 2, 6 or by the lines of contact 9, 10. Between these lines of contact the strip is in form-fitting contact with the straightening roll 7.

To enable the depth of immersion and thus also the angle of wrap $\alpha$ (see FIG. 4) determined by the radius of the straightening roll or the lines of contact to be changed according to the strip thickness and the strength of the strip material, the backing rolls 8, the guide roll 6 and the straightening roll 7 are mounted in such a manner that they can be pivoted about a centre of motion 11.

Depending on the direction in which the console is pivoted, either the underside of the strip (when pivoted downwards) or the upper side (when pivoted upwards) is plastically deformed. In the case of pivoting upwards the guide roll 6 becomes a straightening roll 7 and the straightening roll 7 becomes a guide roll, acting in combination with the guide roll 1.

Figure 3:
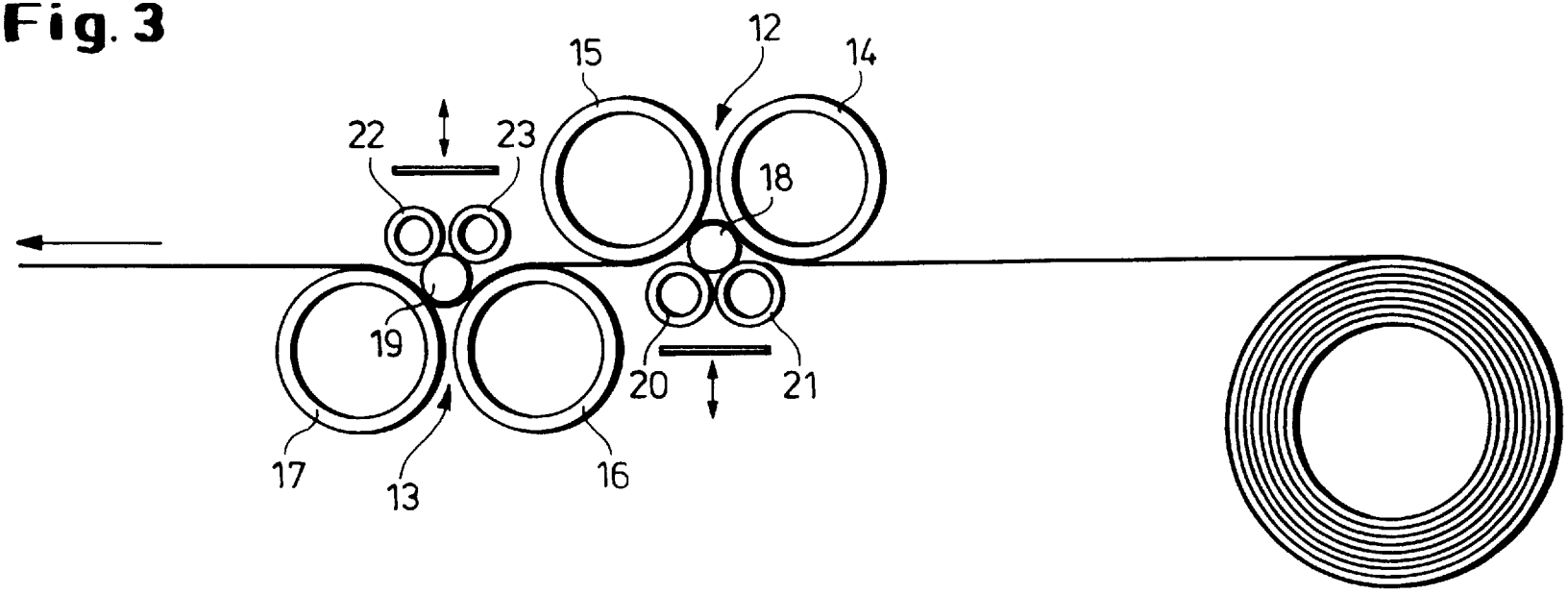
FIG. 3 shows a bend-straightening apparatus having one straightening roll and two guide rolls with the same diameter.

The bend-straightening apparatus shown in FIG. 3 comprises two sets of rolls 12, 13 each having two guide rolls 14, 15 and 16, 17 respectively, in the gusset spaces of which a respective straightening roll 18, 19 is mounted. The straightening rolls 18, 19 are supported by backing rolls 20, 21 and 22, 23 respectively.

Figure 4:
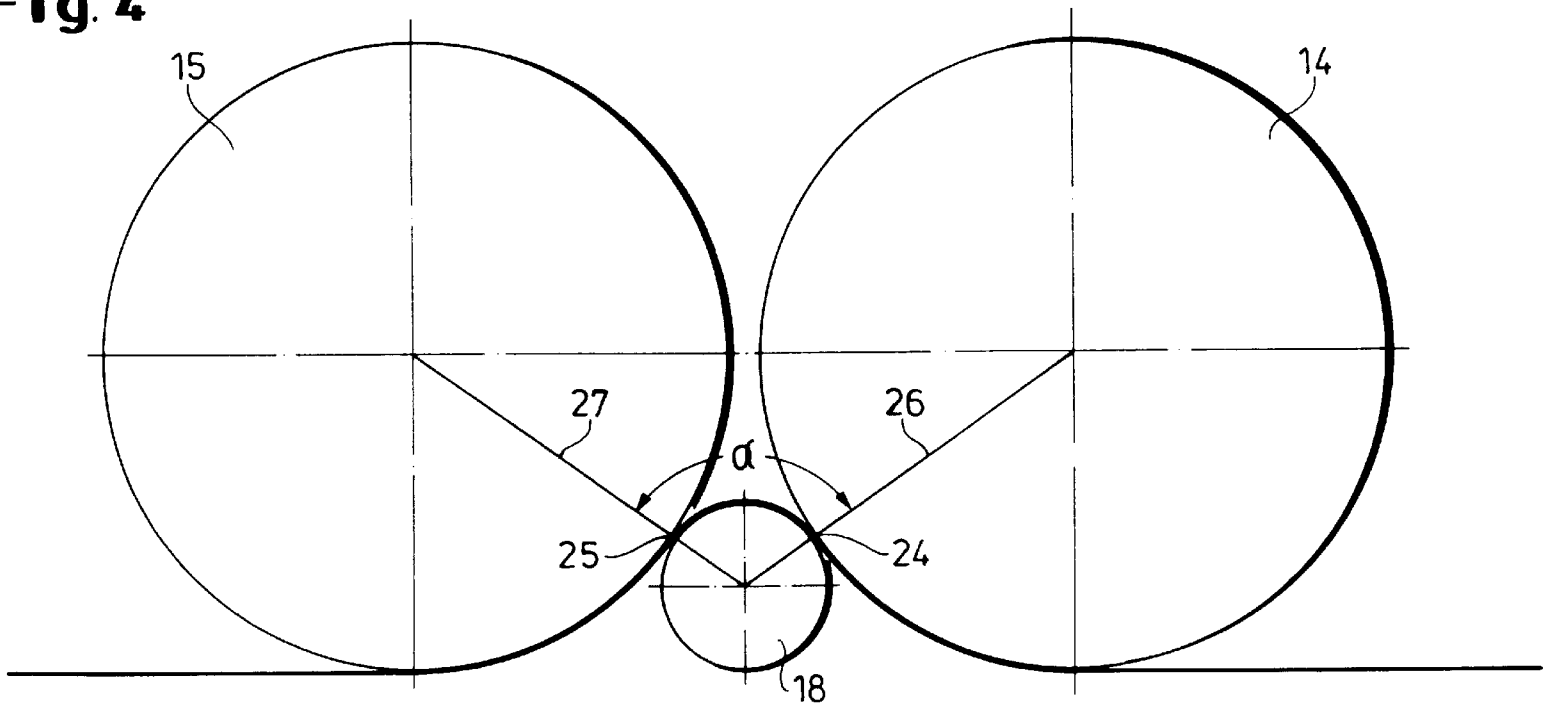
FIG. 4 is an illustration, on a larger scale, of the straightening roll on the feed side and the two guide rolls associated therewith.
Figure 5:
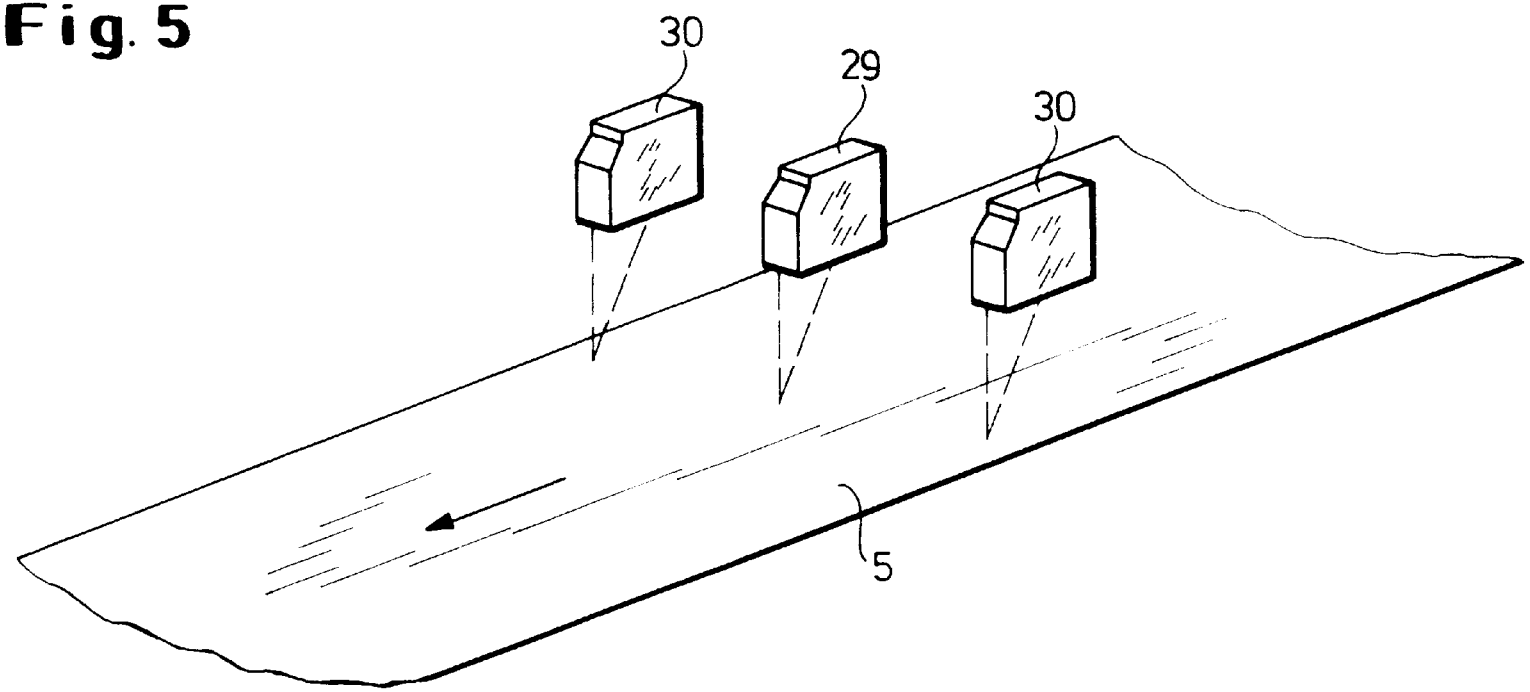
FIG. 5 shows an apparatus for measuring the curvature of the strip transverse to the direction of travel of the strip.

As shown in FIG. 4, the radii 26, 27 of the guide rolls 14, 15 which pass through the lines of contact 24, 25 of the strip with the straightening roll intersect in the centre of the straightening roll 18 they form an equilateral triangle and include the angle of wrap $\alpha$.

The strip 5 to be straightened is passed through the straightening gap 24 between the guide roll 14 and the straightening roll 18 and through the straightening gap 25 between the guide roll 15 and the straightening roll 18, and consequently, in the apparatus shown in FIG. 3, it comes into a form-fitting connection with the straightening roll 18, the radius of which, combined with the depth of immersion, brings about a bending deformation such that (i.e. such a sharp bending of the strip on the side of the strip remote from the straightening roll that) stretching of the strip by tensile loading is unnecessary. It is solely the geometry of the rolls which performs the required work of straightening, without any substantial participation of the tension in the strip. According to which side of the strip is to be plastically deformed, the strip is deformed either in the roll assembly 12 (deformation of the upper side of the strip) or in the roll assembly 13 (deformation of the underside of the strip).

On the exit side three sensors 29, 30 are arranged above the strip 5 by means of which any curvature of the strip remaining after the straightening can be determined and compared with an intended value. Using an algorithm, it is thus possible to control the straightening rolls.

What is claimed is:

1. Apparatus for straightening a metal strip by bending without tension deformation, the apparatus comprising:

guide rolls arranged parallel to one another; and a straightening roll arranged in a gusset space between two guide rolls, wherein the strip wraps in a form-fitting manner around the straightening roll between two lines of contact, along which the guide rolls are in indirect contact with the straightening roll, and wherein the apparatus straightens the metal strip by bending without tension deformation.

2. Apparatus as claimed in claim 1, wherein radii of the guide rolls, which intersect at a center of the straightening roll, pass through the lines of contact.

3. Apparatus as claimed in claim 1, wherein the straightening roll is adjustably mounted.

4. Apparatus as claimed in claim 1, wherein the straightening roll is mounted on a pivot arm.

5. Apparatus as claimed in claim 1, wherein the straightening roll is mounted to be adjustable in a plane normal to a plane of the strip.

6. Apparatus as claimed in claim 1, wherein at least one of the straightening roll and the guide rolls is supported by at least one backing roll.

* * * * *